US005697302A

United States Patent [19]

Putnam

[11] Patent Number: 5,697,302

[45] Date of Patent: Dec. 16, 1997

[54] SHELF COVER

[76] Inventor: Michael A. Putnam, 4961 Lower Roswell Rd., Marietta, Ga. 30068

[21] Appl. No.: 834,083

[22] Filed: Apr. 14, 1997

Related U.S. Application Data

[63] Continuation of Ser. No. 643,552, May 6, 1996, abandoned.

[51] Int. Cl.[6] ..... A47B 13/08

[52] U.S. Cl. ..... 108/90; 150/158

[58] Field of Search ..... 108/90, 51.1, 55.1, 108/55.3, 901; 150/158, 154

[56] References Cited

U.S. PATENT DOCUMENTS

| | | | |
|---|---|---|---|
| Re. 29,192 | 4/1977 | Anderson et al. | 108/55.3 X |
| 1,979,578 | 11/1934 | Simmons . | |
| 2,714,559 | 8/1955 | Sheffield et al. . | |
| 3,452,497 | 7/1969 | Warp . | |
| 3,738,405 | 6/1973 | Ericson | 108/90 X |
| 4,196,244 | 4/1980 | Roman . | |
| 4,603,074 | 7/1986 | Pate et al. . | |
| 4,616,434 | 10/1986 | Riba et al. | 108/90 X |
| 4,708,183 | 11/1987 | Figueroa | 108/90 |
| 4,716,840 | 1/1988 | Tringali et al. | 108/90 X |
| 4,750,402 | 6/1988 | Markey | 108/90 X |
| 4,844,972 | 7/1989 | Tedeschi et al. . | |
| 4,917,932 | 4/1990 | McClung . | |
| 5,284,099 | 2/1994 | Cohen | 108/90 |

FOREIGN PATENT DOCUMENTS

| | | | |
|---|---|---|---|
| 642491 | 4/1964 | Belgium | 108/90 |
| 1414638 | 11/1975 | United Kingdom | 108/51.1 |

*Primary Examiner*—Jose V. Chen

*Attorney, Agent, or Firm*—Dean W. Russell; Michael F. Labbee; Kilpatrick Stockton LLP

[57] ABSTRACT

A relatively thick shelf covering for use with wire-frame shelves. The material is sufficiently thick to prevent objects from falling through or tilting into the spaces between the gratings of a wire-frame shelf. The material is also flexible enough to be sold in rolls. The material is also impervious to water and most common household chemicals.

3 Claims, 1 Drawing Sheet

SHELF COVER

CROSS-REFERENCE TO RELATED APPLICATIONS

This application is a continuation of application Ser. No. 08/643,552, filed May 6, 1996, by Michael A. Putnam, entitled "SHELF COVER", now abandoned.

1. Field of the Invention

This invention relates to shelf coverings for use with wire-frame shelves.

2. Background of the Invention

Shelving used in storage compartments, bookcases, cupboards and medicine cabinets may be made from a variety of materials such as wood, glass, plastic, etc. One popular approach is to use a wire-frame construction. As can be seen in FIG. 1, a wire-frame shelf generally uses two or more longitudinal members 2 with a number of closely spaced cross-members 3. This structure is aesthetically pleasing, and both lightweight and inexpensive because substantially less material than traditionally used can create the same amount of shelf space. A limitation of these shelves, however, is that any articles smaller than the distance 4 between any two cross-members 3 will fall through the shelf. Similarly, any object not substantially larger than the distance 4 between any two cross-members 3 will tend to tilt to one side or another. These limitations tend to frustrate the purpose of shelving—i.e., to permit the user efficiently and neatly to store items in a given storage area. Thus it would be desirable to provide a means for keeping store items neatly stored on wire-frame shelves while preserving the advantages of such shelving.

A solid shelf covering can be employed. However the use of plastic, glass or other heavy solids to cover the wire-frame shelf would defeat many of the advantages of wire-frame shelving, such as low cost and low weight. A solid shelf covering would also have a tendency to slide off of the shelf. An adhesive coating of some form might be used to prevent slippage, however this would increase the manufacturing cost of such a covering.

A cardboard covering can be used to reduce cost and weight. Without some form of coating, however, the cardboard would be susceptible to puncture or water damage—threats common to usage in the home. This can be resolved with coatings, such as that disclosed in U.S. Pat. No. 1,979,578 to Simmons, to render the material impervious. However, the application of such coatings tends to increase the manufacturing complexity and hence the cost of the device. Furthermore, both solid coverings and cardboard coverings would be bulky and therefore difficult to market.

Conventional flexible shelf coverings made from paper, plastic, vinyl and other flexible materials are available. Because these materials are flexible, they can be conveniently marketed in rolls. Nonetheless, these coverings are designed for solid shelves; thus, they do not provide adequate support on a wire-frame shelf. In addition, these coverings are thin and can be easily damaged, requiring frequent replacement. Also, because they are very lightweight, conventional coverings are easily displaced from their intended position, and thus require some form of adhesive layer to bond them to the surface to which they are applied.

Many wire-frame shelves have a frontal grate portion 30 as in FIG. 6. For aesthetic reasons, it would be desirable for a shelf covering also to cover this portion. A solid coveting could be hinged in some fashion to provide this function, however such a structure would inevitably increase the cost and complexity of the device. Conventional flexible coverings would need to be folded and, due to their light weight, would tend to be easily displaced, creating and unsightly and unkempt appearance, thus requiring an adhesive layer.

SUMMARY OF THE INVENTION

The present invention provides a shelf cover for wire-frame shelves with the benefits of both rigid and flexible shelf covers. The shelf cover of the present invention is constructed from a relatively thick but flexible material. The material is sufficiently thick to avoid deformation when placed on a wire-frame shelf and sufficiently flexible to be rolled up for storage or sale. The material may also have a lateral notch along the underside of the cover so that a portion of the cover may be folded down to cover the frontal grating of the shelf. Because the material is inherently heavy, it tends to hang down under the force of gravity and is not prone to flying up and exposing the underlying grating.

In order to prevent the material from sliding off the shelf, the material is sufficiently soft so that the wire cross members tend to make a slight impression or indentation in the material. This indentation helps seat the material on the cross members, preventing the material from sliding off the shelf. One side of the material may be textured or coated with an adhesive to further prevent slippage. Also, one side of the material may be treated so that it tends to adhere gently to the vinyl coating that is generally found on wire-frame shelves. The cover may also have two layers, where the bottom layer uses a material that adheres to the vinyl coating. In addition, the material is impervious to water and other chemicals or solvents normally found in the home, allowing it to be easily cleaned. The material is also very durable, requiring infrequent replacement.

It is therefore an object of the present invention to provide a shelf covering for use with wire-frame shelves that is flexible yet rigid enough to avoid deformation between the cross members of the shelf.

It is also an object of the present invention to provide a shelf covering that will not easily slide off the shelf.

It is a further object of the invention to provide a shelf covering that is impervious to water, easily cleaned and durable.

Yet another object of the invention is to provide a shelf covering that is capable of covering the frontal grating portion of a wire-frame shelf.

Other objects, features and advantages of the present invention will become apparent with reference to the remainder of the written portion and the drawing of this application.

DETAILED DESCRIPTION OF THE DRAWINGS

Figure 1:
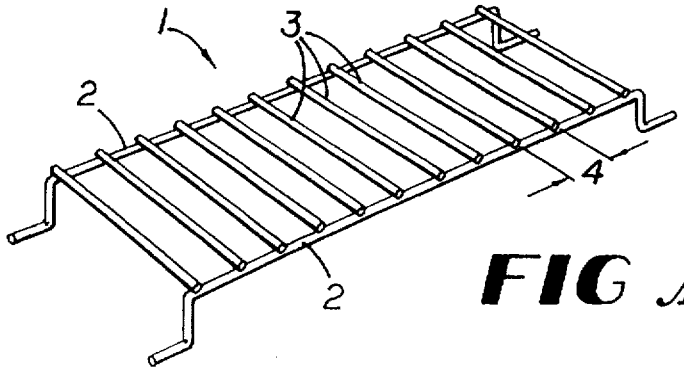
FIG. 1 is a perspective view of a conventional wire-frame shelf.

FIG. 1 shows a conventional wire-frame shelf 1. The shelf 1 is composed of at least two parallel longitudinal members 2 spanned by numerous cross members 3. The cross members 3 are separated by a distance 4 which may vary depending on the size and intended use of the shelf. For instance, smaller shelves used in medicine cabinets may have a distance 4 of less than one half of an inch. Larger shelves used for storage closets may have a distance 4 of three quarters of an inch or more. The wire-frame shelf has risen in popularity for a number of reasons, including aesthetic appearance, low weight and low cost. Nonetheless, the wire-frame shelf does present a significant drawback. Any items that are not substantially larger than the distance 4 will tend to topple or even fall through the shelf. This frustrates the intended purpose of the shelf, which is to allow the orderly storage of various items.

Figure 2:
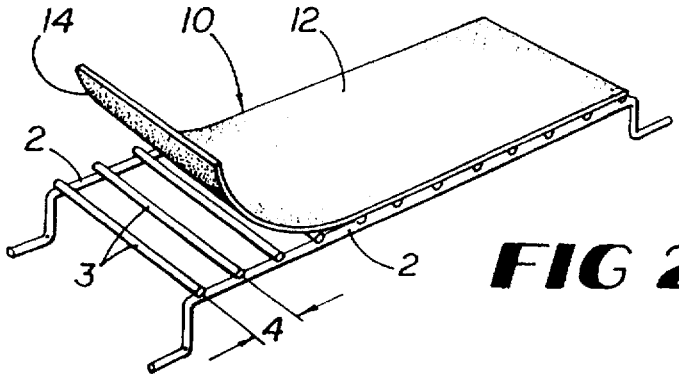
FIG. 2 is a perspective view of the shelf of FIG. 1 with a cover consistent with the present invention partially installed thereon.

FIG. 2 illustrates a shelf cover 10 that effectively eliminates the problem created by the wire-flame shelf 1. A flexible and relatively thick material is used to make a shelf cover 10. The material may be vinyl, plastic, rubber or paper, and it has been found that polyvinyl chloride (PVC) provides a variety of beneficial qualities. First, PVC is very flexible. This allows the cover 10 to be rolled up for marketing and sale. PVC is easily cut, allowing the cover 10 to be trimmed to fit. PVC is impervious to water and most household chemicals, making it durable and easy to clean. PVC also can easily be made in different thicknesses.

Figure 3:
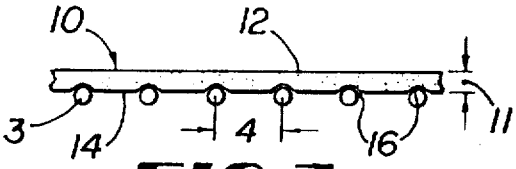
FIG. 3 is a cross-sectional view of a portion of the shelf of FIG. 1 with a cover consistent with the invention installed thereon.

The ability to vary the thickness is important, because, as seen in FIG. 3, the thickness 11 of the cover 10 ensures that the cover 10 can support objects in between the cross-members 3. Given a constant rigidity of the cover 10 for a given thickness 11, the deformation of the cover 10 into the space defined by distance 4 is proportional to the magnitude of the distance 4. Thus, as distance 4 increases, a cover 10 of a given thickness will tend to "droop" into the space. The amount of droop for any thickness 11 and distance 4 is determined by the inherent rigidity of the material from which the cover 10 is made. Thus, for a shelf with cross members 3 spaced at a distance 4 of one half inch, a cover 10 made of PVC with a thickness of one eighth inch might have no perceptible droop. A cover 10 made of PVC with a thickness of one thirty-second inch might have a perceptible droop. It has been determined that a cover 10 made of PVC with a thickness of approximately one-sixteenth inch has no perceptible droop for distances 4 of up to one and one-half inch and is thus functional for the conventional range of distances 4 used in wire-frame shelves. If other materials other than PVC are used, experimentation will determine the appropriate thickness 11 to avoid perceptible droop.

Figure 4:
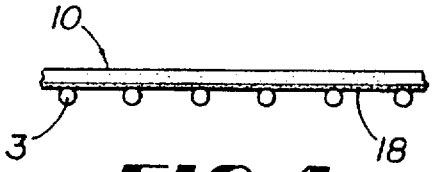
FIG. 4 is a cross-sectional view of a portion of the shelf of FIG. 1 with a cover consistent with a second embodiment of the invention installed thereon.
Figure 5:
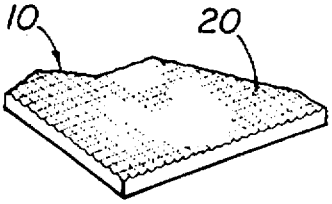
FIG. 5 is a perspective view of the cover showing the corrugations of a first embodiment.

Another advantage of using PVC is that it is slightly compressible. As can be seen in FIG. 3, when the cover 10 is placed on the shelf 1, the portions of the cover 10 resting on the cross members 3 deform slightly to create indentations 16. These indentations 16 help the cover 10 "grip" the cross members 3 to prevent the cover 10 from sliding off the shelf 1. Other means for ensuring a non-slip installation can also be used. For example, as illustrated in FIG. 4, a layer of heat-activated adhesive 18 may be applied to the bottom face 14 of the cover 10. The cover 10 is applied to the shelf 1 and heat is applied to affix the cover 10 to the shelf 1. Another alternative, as shown in FIG. 5, is to provide corrugations 20 on the bottom face 14 of the cover 10. These corrugations 20 roughen the bottom face 14 and increase the friction between the cover 10 and the shelf 1, thereby reducing slippage.

Figure 8:
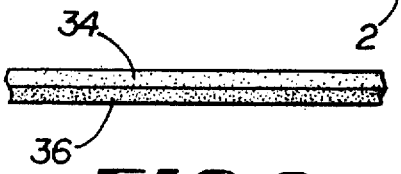
FIG. 8 is a cross-sectional view of a cover consistent with a third embodiment of the invention.

Another approach (not illustrated) that may be used to ensure a proper grip is to treat the bottom face 14 of the material to soften it somewhat. The softening will have the effect of making the material slightly adherent to the vinyl covering that is generally used on wire-frame shelves. A variation of this approach is seen in FIG. 8, where a bi-layer approach is used. A top layer 34 is made of the flexible and relatively thick material, while a bottom layer 36 is made of a softer material that is naturally adherent to the vinyl covering on the wire shelf. The layers 34 and 36 may be bonded with glues, heat melding or other conventional means. This approach provides the advantage of allowing selection of particular material matched each function, rather than selecting one material that meets the principal function and yet can be treated so as to provide the desired adherence.

Figure 6:
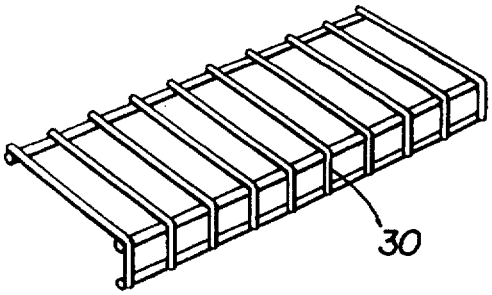
FIG. 6 is a perspective view of a wire frame shelf with a frontal grate.
Figure 7:
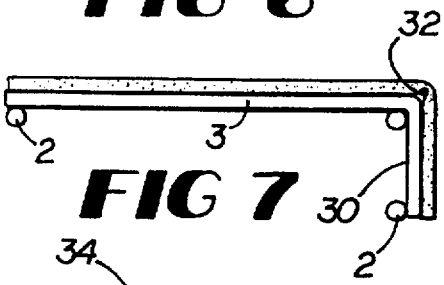
FIG. 7 is a cross-sectional view of a cover of the invention adapted to be used with the grate of FIG. 6.
Figure 9:
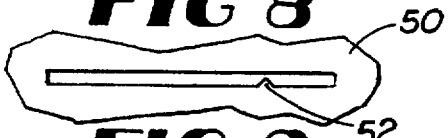
FIG. 9 is a partial elevation of an extrusion mold for extruding the cover of FIG. 7.

Some typical wire-frame shelves, as in FIG. 6, will include a frontal grating 30 for aesthetic purposes. For the same reason, it would be desirable for the cover 10 to drape over the frontal grating 30. As see in FIG. 7, a small notch 32 can be made in the bottom surface 14 of the cover 10. This notch 32 allows the cover 10 to be folded down over the frontal grating 30. The notch 32 can be applied to any of the embodiments, including the bi-layer embodiment seen in FIG. 8, the corrugated embodiment seen in FIG. 5 and the adhesive embodiment as seen in FIG. 4. The notch 32 can be formed during the manufacturing process. For example, if the material is extruded, as in FIG. 9, the notch 32 can be incorporated into the extrusion mold 50 by providing a notch forming means 52. Also, once the material is formed, it may be drawn over a knife blade (not illustrated) that cuts the desired notch 32 in the bottom face 14.

Although the foregoing is provided for purposes of illustrating, explaining and describing embodiments of the present invention, modifications and adaptations to these embodiments will be apparent to those skilled in the art and may be made without departing from the scope or spirit of the invention.

I claim:

1. A removable, reusable covering for a wire-frame shelf having a frontal grating and cross-members defining gaps therebetween, which covering has a length, is in the form of a roll prior to use, and includes:

a. an upper surface impervious to water;

b. a lower surface having:

i. means, comprising a notch spanning the length, for following the contour of the frontal grating when in use; and ii. non-adhesive means, comprising corrugations, for preventing movement of the lower surface relative to the shelf when in use; and c. a thickness of at least approximately one-sixteenth inch and sufficient to support objects placed on the upper surface over gaps between cross-members; and which covering is made from extrudable material selected from the group consisting of vinyls, plastics, and rubbers.

2. A system for supporting objects comprising:

a. a wire-frame shelf having a top surface comprising a plurality of approximately uniformly spaced cross-members; and b. a sheet of material having:

i. a top face impervious to water;

ii. a bottom face lacking adhesive, the bottom face being positioned on the top surface of the wire-frame shelf, in contact with the cross-members, so as to be removable therefrom for subsequent reuse;

iii. sufficient compressibility such that when the bottom face is positioned on the top surface of the wire-frame shelf, the cross-members create indentations on the bottom face; and iv. a thickness proportional to the spacing between adjacent cross-members such that the material does not droop substantially in spaces between the cross-members.

3. A removable, reusable covering for a wire-frame shelf having a frontal grating, which covering has a length and includes:

a. an upper surface impervious to water;

b. a lower surface having:

i. means, comprising a notch spanning the length, for following the contour of the frontal grating when in use; and ii. means, comprising corrugations, for preventing movement of the lower surface relative to the shelf when in use; and c. a thickness sufficient to support objects placed on the upper surface; and which covering is made from extrudable material.

* * * * *